United States Patent [19]

Louviere

[11] 4,210,213

[45] Jul. 1, 1980

[54] KELLY BUSHING GUARD

[76] Inventor: Huey P. Louviere, 1811 Donna Dr., Franklin, La. 70538

[21] Appl. No.: 890,642

[22] Filed: Mar. 20, 1978

[51] Int. Cl.[2] ..... E21B 41/00

[52] U.S. Cl. ..... 175/195; 173/165; 175/219; 74/609

[58] Field of Search ..... 74/608, 609; 173/165, 173/166, 167; 175/195, 209, 211, 219; 166/81; 64/23.5, 23.6, 23.7

[56] References Cited

U.S. PATENT DOCUMENTS

| | | | |
|---|---|---|---|
| 1,478,953 | 12/1923 | Happ et al. | 74/609 |
| 2,879,035 | 3/1959 | Tilden | 175/209 |
| 3,322,198 | 5/1967 | McHenry | 166/81 |
| 3,902,555 | 9/1975 | Edge et al. | 166/81 |
| 3,910,359 | 10/1975 | Childress | 74/609 |

*Primary Examiner*—Kenneth Dorner

*Attorney, Agent, or Firm*—Keaty and Garvey

[57] ABSTRACT

A Kelly Bushing Guard is comprised of an outer protective guarding shell which coverably mounts on the kelly bushing portion of a drilling apparatus. The outer shell is comprised of an upper smaller shell section which is mountable on the kelly bushing itself, there being provided an upper opening through the upper shell portion allowing the passage of the kelly therethrough. A lower shell section is integrally attached to the upper shell section, the lower shell section coverably registering with and guarding the rotary table portion of a well drilling apparatus. An improved cushioned mounting is provided which can be in the form of a plurality of pliable rubberized rings. The larger lower shell section provides a free space under the upper shell section which free space allows the kelly bushing to freely rotate therewithin. Rotation of the kelly bushing within the free space does not impart a rotation to the outer shell, but allows it to protectively cover the kelly bushing and rotary table during drilling operations when the kelly bushing and rotary table are interlocked and rotating together. An alternative embodiment provides a two part bushing guard wherein the upper shell portion disengages from the lower shell portion and rises with the kelly during drilling operations. The lower portion can be hinged to provide a lower shell section which is easily removable from its position which guards the rotary table.

13 Claims, 8 Drawing Figures

FIGURE 4A
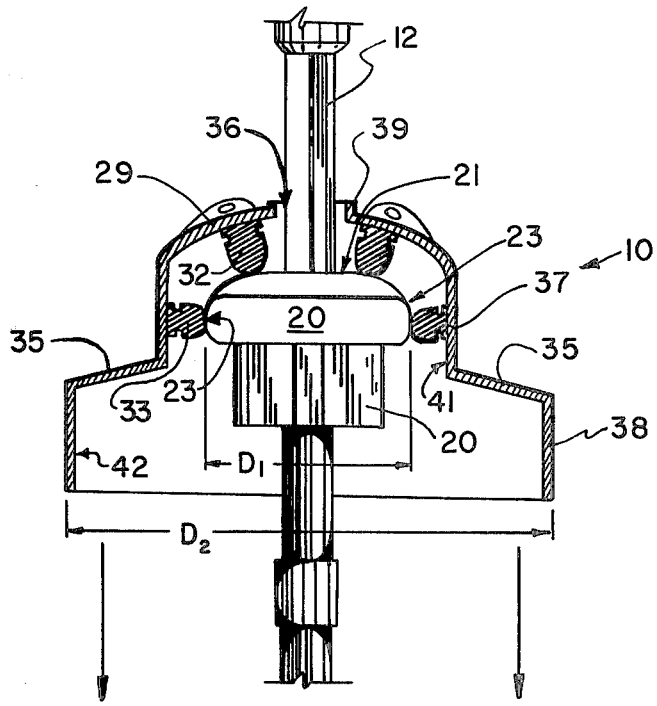
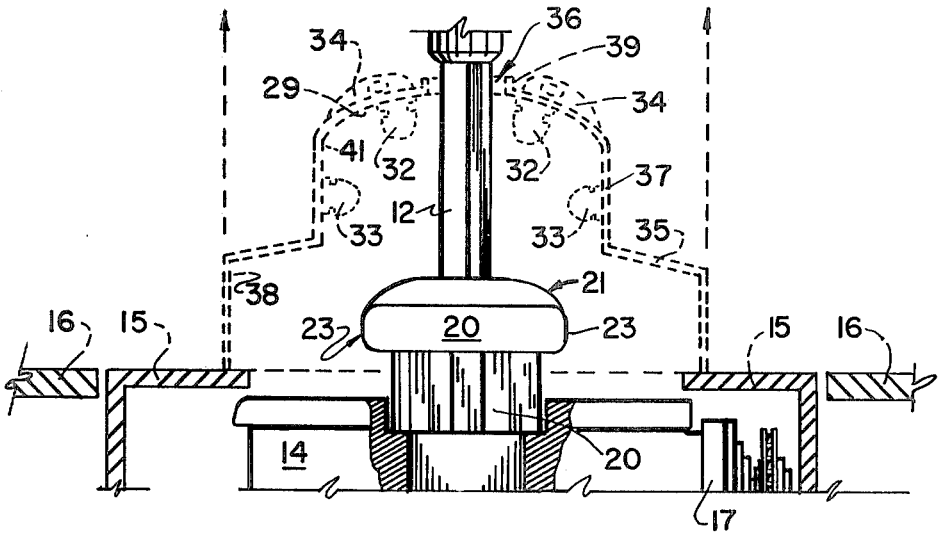
FIGURE 4B

FIGURE 7
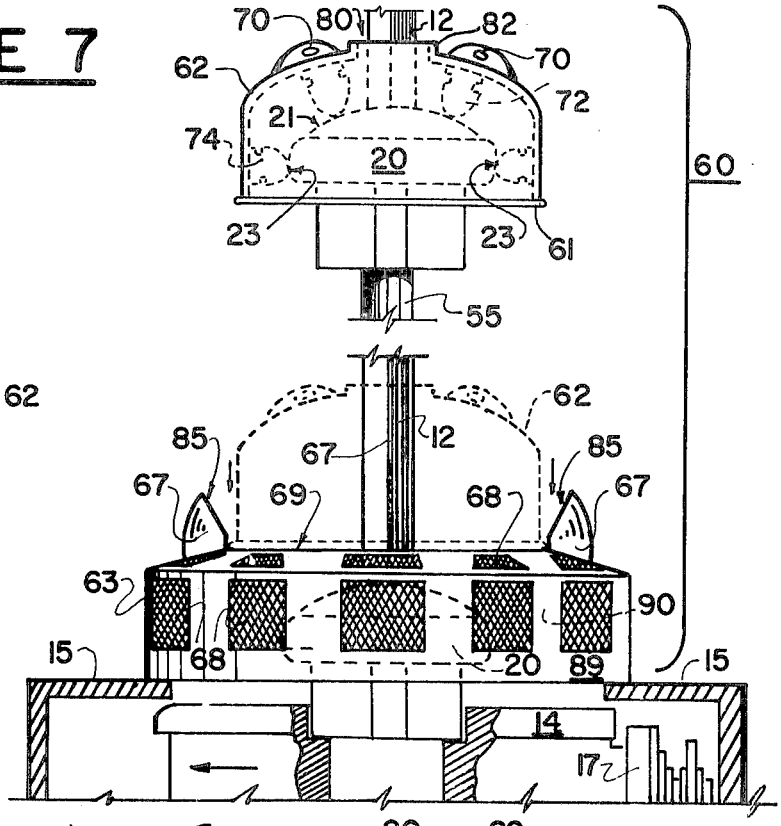
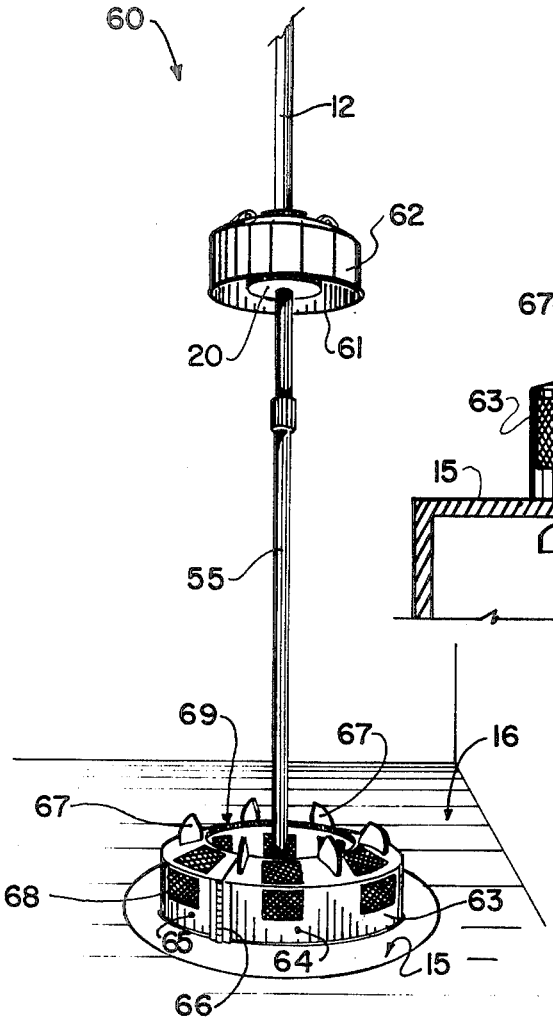
FIGURE 5
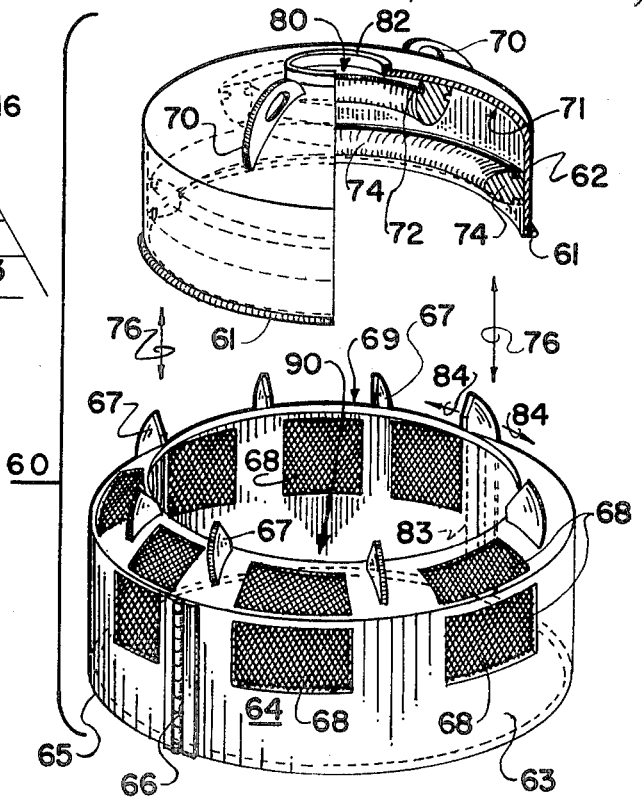
FIGURE 6

KELLY BUSHING GUARD

BACKGROUND OF THE INVENTION

1. Field of the Invention

The present invention relates to guards and safety guards for well drilling equipment, and more particularly relates to an improved kelly bushing guard which protectively covers a portion of the well drilling kelly, the kelly bushing guard, and the rotary table portions of the well drilling rig during drilling operations.

2. General Background and Prior Art

Various cage or casing type protective devices have been used to separate personal from machinery and related equipment utilized on off-shore and like well drilling rigs. These protective devices are generally stationery and are used to prevent personal from coming in contact with moving parts of machinery which could snag the individual or his clothing.

In well drilling operations such as is the case in oil well or gas well drilling operations, protective devices are of great value since machinery utilized has a tremendous amount energy and can mutilate or injure or kill personal who may become tangled or inadvertently contacted therewith.

Specifically, the well drilling rotary table, the well drilling kelly, and the kelly bushing are three such parts which at certain times in the drilling operation are moved and contain a tremendous amount of energy capable of inflicting injuries.

Several devices have been patented which have attempted to solve the problems of shielding dangerous machinery. Some of these devices have particular application to the oil field and to oil well drilling rigs and related devices.

The following table provides a listing of some prior art devices which have been patented.

| Prior Art Patents | | |
|---|---|---|
| U.S. Pat. No. | Inventor | Issue Date |
| 2,312,323 | O. L. Derrick | March 2, 1943 |
| 2,559,100 | W. L. White | July 3, 1951 |
| 2,592,633 | J. H. Wilson | April 15, 1952 |
| 2,719,025 | A. L. Stone | Sept. 27, 1955 |
| 2,730,333 | W. E. Lenhart, Jr. | Jan. 10, 1956 |
| 2,789,870 | J. W. E. Hanes | April 23, 1957 |
| 2,959,453 | H. C. Jacobs | Nov. 8, 1960 |
| 3,019,063 | C. H. Collett | Jan. 30, 1962 |
| 3,038,537 | W. D. Brunig | June 12, 1962 |
| 3,051,532 | C. H. Collett | Aug. 28, 1962 |
| 3,063,509 | W. C. Guier | Nov. 13, 1962 |
| 3,078,933 | A. B. Orner | Feb. 26, 1963 |
| 3,111,863 | D. J. Filz | Nov. 26, 1963 |
| 3,270,810 | L. A. Johnston | Sept. 6, 1966 |
| 3,322,198 | W. L. McHenry | May 30, 1967 |
| 3,612,627 | L. E. Fuller | Sept. 23, 1969 |
| 3,910,359 | A. J. Childress | Oct. 7, 1975 |
| 3,913,352 | D. L. Oliver | Oct. 4, 1973 |
| 459,065 German | F. F. Stille | Aug. 19, 1927 |

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein:

FIGS. 4A–4B are schematic illustrations of the operation of the preferred embodiment of the apparatus of the present invention;

FIG. 5 is a perspective of an alternative embodiment of the apparatus of the present invention illustrating its operation;

FIG. 6 is a partially cut away perspective view of the alternative embodiment of the apparatus of the present invention showing the upper most section in its raised or unconnected position; and FIG. 7 is a schematic illustration of an alternative embodiment of the apparatus of the present invention shown in operation with the upper most portion in a raised postion and mounting on the kelly, with the kelly shown in phantom lines in its operational position adjacent the rotary table.

DETAILED DESCRIPTION OF THE PREFERRED EMBODIMENTS

Figure 1:
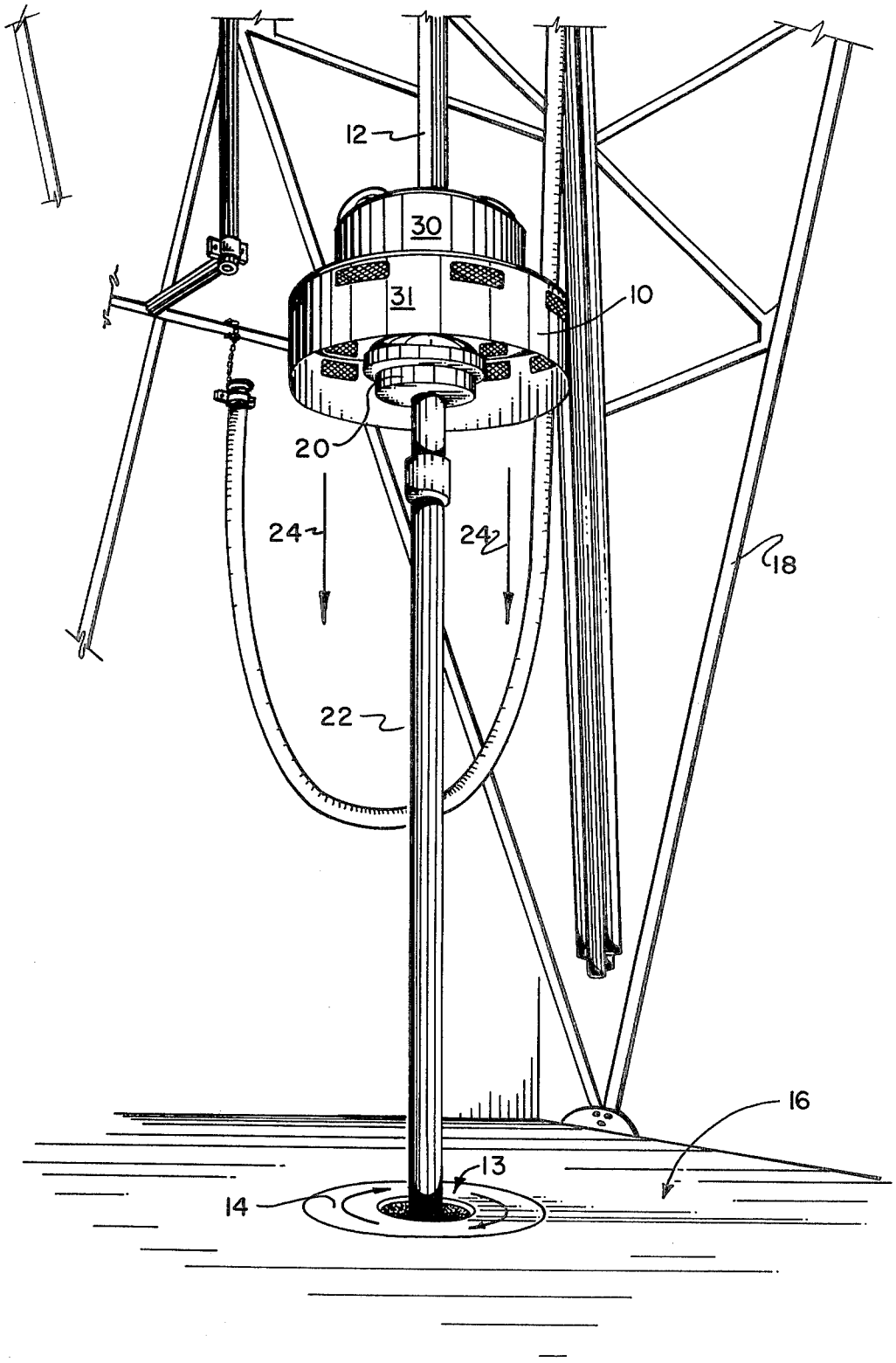
FIG. 1 is a perspective view of the preferred embodiment of the apparatus of the present invention shown in use on a typical well drilling rig.

FIG. 1 best illustrates the preferred embodiment of the apparatus 10 of the present invention. In FIG. 1 Kelly Bushing Safety Guard 10 can be seen in use with a typical oil well drilling rig which includes a derrick support portion 18 and a rig deck 16. Shown in FIG. 1 in a connected assembly with safety guard 10 is kelly 12, kelly bushing or rotary drive bushing 20, and drill stem 22. A plurality of cables combine with a plurality of pulleys extend above the kelly 12 and support the kelly 12, kelly bushing 20, and drill stem 22 to a substantially vertical posture as is shown in FIG. 1. Note that a rotary table 14 is provided on the deck 16 portion of the drilling rig, an opening provided through rotary table 14 as is best illustrated in FIG. 1. The opening 13 is shaped to drivingly receive the lower end portion of the kelly bushing 20 thereinto. Thus, a coupling is formed between the kelly bushing 20 and rotary table 14 when the kelly bushing 20 decends as is illustrated by arrows 24 in FIG. 1, to couple with and lock into rotary table 14, as is known in the art.

The kelly bushing is provided with a central axial opening (not shown) which is shaped in cross-section in a corresponding shape to drivingly receive and engage kelly 12 therethrough. Thus, the rotation of rotary table 14 as is illustrated by the curved arrows in FIG. 1 likewise imparts rotation to kelly bushing 20 and kelly 12 and drill stem 22 as is known in the art.

Figure 2:
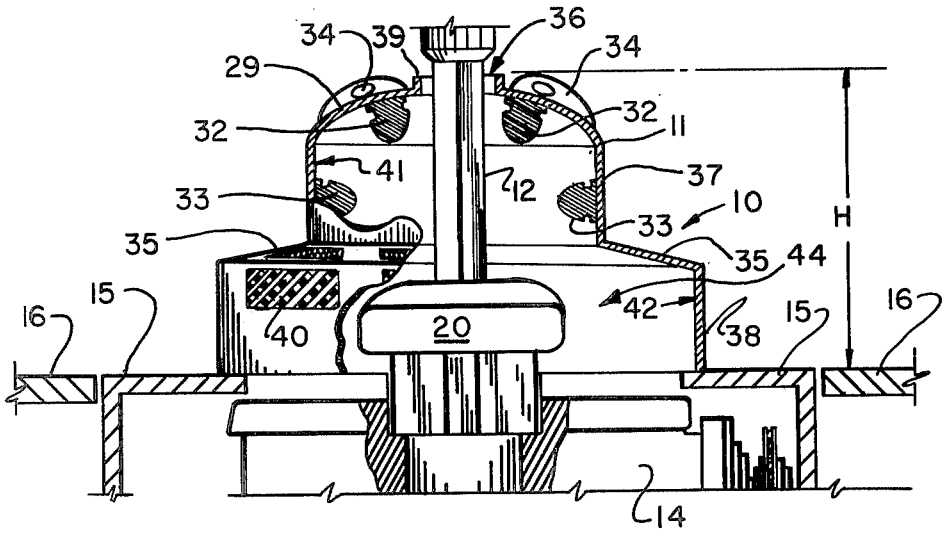
FIG. 2 is a sectional view showing the Kelly Bushing Guard of the present invention in its operative guarding position on the rig platform floor while the kelly bushing and rotary table are engaged rotating together.

The rotary table 14 is connected to a power drive 17 by way of a drive connection (not shown) as is schematically illustrated in FIGS. 2 and 4. The powerdrive thus drivingly rotates the rotary table 14 through the drive connection, the rotary table 14 imparting rotary motion to the drill stem 22, the kelly 12, and the kelly bushing 20 as afore described.

In FIG. 1 there can be seen a kelly bushing safety guard 10 which forms the subject of the present invention. Kelly bushing safety guard 10 is comprised of an upper guard shell section 30 and a lower guard shell section 31. Note that the upper guard shell section 30 is generally smaller in diameter than is lower guard shell section 31. Both shell sections are substantially cylindrical in shape. Lower shell section 31 provides a cylindrical shape being sized to substantially coverably register with rotary table 14 forming a protective barrier therearound. If desired, a ridge (not shown) of for example flat bar could be peripheraly connected by welding or the like about the edge portion of rotary table 14 on rig deck 16. This peripheral ridge could be sized slightly smaller than the inner diameter of lower shell section 31 thus providing a mating edge for the attachment of the lower edge portion of kelly bushing guard 10 thereto.

STRUCTURE

Figure 3:
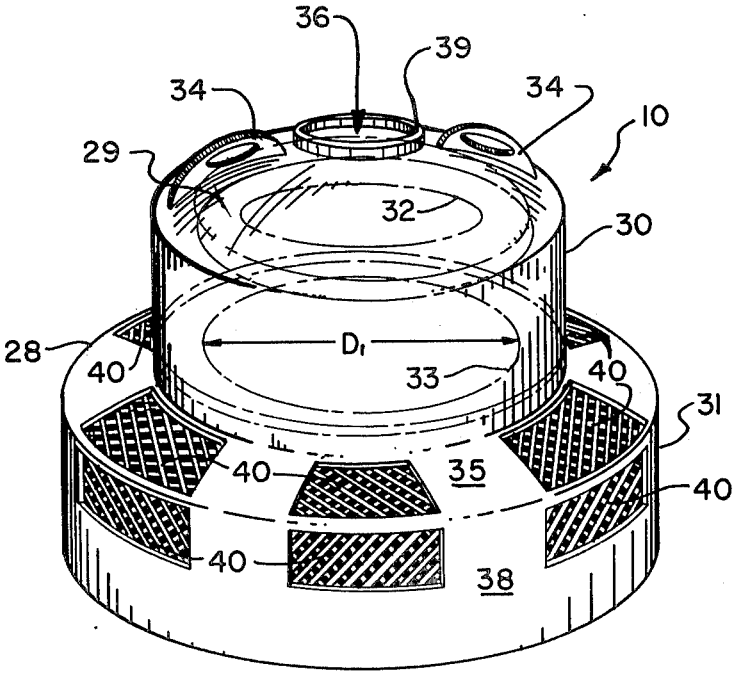
FIG. 3 is a perspective view of the preferred embodiment of the apparatus of the present invention showing the improved ring mounting assembly and the upper portion thereof.

FIGS. 2 through 4 best illustrate the structure of the preferred embodiment of the apparatus 10 of the present invention. In FIG. 3, there can be seen a safety kelly bushing guard 10 which is comprised generally of an upper guard shell section 30 and a lower guard shell section 31. Upper shell section 30 and lower shell section 31 are intergrally connected by means flared skirt 35 as can best be seen in FIG. 3.

Upper guard shell section 30 is comprised of sidewall 37, and an upper guard shell domed cover 29. A pair of lift-eyes 34 can be provided on domed cover 29 for lifting guard 10 if desirable. A central, circular opening 36 is provided in cover. 30. Note from an inspection of FIG. 2 that opening 36 is sized to allow the passage of well drilling rig kelly 12 therethrough. A reinforcing annular ring 39 can be provided to the outer peripheral edge portion of opening 36 is desirable.

Lower guard shell section 31 is comprised of a lower guard shell section sidewall 38 which can be provided with a plurality of screens 40 which allow inspection to the inner portion of guard 10 and the rotary table or kelly bushing thereunder. Screens 40 can be likewise be provided in flared skirt 35 as is illustrated in FIG. 3.

From the above, it can be seen that in outer guard shell 28 is provided which is comprised of upper shell section 30, lower shell section 31, and flared skirt 35. These sections are intergrally attached by welding or like means. The entire outer shell 28 can be manufactured of any suitable structural material such as steel.

In FIG. 3, there can be seen a pair of inner annular gripping liner rings 32,33. As will be described more fully herein after, these liner rings provide a pliable gripping surface for contacting the sidewall and upper portion of kelly bushing 20 (note FIG. 4) during operation of the well drilling rig apparatus.

Lower most liner ring 33 is provided with a diameter D1 which is substantially identical with the outer diameter of kelly bushing 20.

FIGS. 2 through 4 illustrate the safety guard 10 of the present invention in operation with a typical well drilling rig apparatus. In FIG. 2, there can be seen the deck or surface 16 portion of the well drilling rig in proximity to the rotary table. A deck structure 15 surrounds rotary table 14 as is illustrated in FIG. 2. Note that rotary table 14 provides a rotating mass which drivingly engages with kelly bushing 20 as is known in the art to turn kelly bushing 20, kelly 12 and the attached drill string 22. In FIG. 2, safety guard 10 has assumed an operative resting position on the deck 15 portion on the well drilling rig. In this position as will be described more fully hereinafter, the rotary table and the kelly bushing are fully protected from workers who are nearby and would be standing normally on the area indicated as deck 15 or deck 16. Note that sidewall 38 portion of lower guard shell section 31 provides a wall preventing the approach of personal into the area adjacent or above the rotary table 14.

A free space indicated generally by the numeral 44 is created below upper shell section 30 and flared skirt 35. It can be seen from an inspection of FIG. 2 that kelly bushing 20 is allowed to freely rotate with rotary table 14 in a driving rotation with no portion of kelly 12, kelly bushing 20, or rotary table 14 touching or otherwise imparting rotational force to guard 10. Thus, guard 10 has assumed a non-rotational guarding position with respect to kelly bushing 20 and rotary table 14 as it rests on the surface 15 of the rig platform. Note from FIG. 2 that guard 10 is manufactured of overall height "H" which allows free rotation of kelly 12 and kelly bushing 20 while protecting kelly bushing 20 and kelly 12 from proximate working personal and at the same time avoiding contact with the kelly, kelly bushing and rotary table so that rotation is not imparted to the guard 10 itself. It can be seen from the above, that kelly bushing guard 10 provides a single integral outer shell 28 which protects kelly 12, kelly bushing 20, and rotary table 14 from proximately located personal during well drilling operations. This is accomplished by utilizing a single integral outer shell 28 which is simple, easy and inexpensive to construct and maintain.

FIGS. 5 through 7 illustrate the structure of the alternative embodiment of the apparatus of the present invention indicated generally by the numeral 60 in FIGS. 5–7. In FIG. 5, there can be seen kelly bushing guard 60 which is comprised of an upper section 62 and a lower section 63. Lower section 63 is a two part section which is comprised of a lower section half 64 and a lower section half 65 as can best be seen in FIGS. 5 and 6. Note that a hinge 66 is provided for allowing the two section halfs 64,65, in a pivotal fashion facilitating easy removal from the rotary table area. In FIG. 6, arrows 84 indicate schematically the direction in which each lower section half 64,65 will move when the respective halves are pivotally moved apart one another about hinge 66. In FIG. 6 note that closure line 83 is schematically illustrated to indicate the point of closure of each lower section half 64,65 in a closed position during operation.

Screens 68 can be provided as shown in FIGS. 5–7 and as aforedescribed with respect to FIGS. 2–3.

In FIG. 5, the kelly bushing 20 is shown as attached to kelly 12 as aforementioned in an uppermost non-operating position. In the alternative embodiment, the entire kelly guard 60 does not rise, but rather the lowermost section 63 remains in a coverable guarding position above the rotary table 14 (See FIG. 6). In FIG. 5 lower guard section 63 can be seen resting on the portion 15 of the rig platform floor 16 adjacent rotary table 14. Drill stem 55 is shown protruding in a downward fashion below kelly bushing 20 and through the opening provided in the rotary table 14. Lower guard section 63 is provided with a plurality of guide plates 67 as is best seen in FIGS. 5–7. A plurality of screens 68 are mounted on lower section 63 providing a means for visual inspection to the inner portion 90 of lower guard section 63.

The construction of upper guard section 62 is best seen in FIG. 6. Note that a pair of lift-eyes 70 are structurally mounted on guard section 62. Lift-eye 70 and guard section 62 can be manufactured with any structural material such as a structural metal, steel, iron, and the like. The attachment of lift-eye 70 to upper section 62 can be by any suitable means such as welding or the like. An opening 80 is provided in the uppermost portion of upper section 62 which opening 80 can be provided with an annular reinforcing rib 82 thereabout. As is best seen in FIG. 7, the kelly 12 can pass through opening 80 as is desirable.

On the inner surface 71 of upper section 62 there is provided a plurality of pliable mounting rings 72,74. Mounting rings 72, 74 are best seen in FIG. 6. An upper ring 72 is provided which abutts the upper surface 21 of kelly bushing 20. A second lower pliable mounting ring 74 is provided on the inner wall 71 of upper section 62. Lower mounting ring 74 abutts and connects in a frictional fashion with the side wall 23 portion of kelly bushing 20 (See FIG. 7).

In operation, upper section 62 will rise with kelly bushing 20 when it leaves rotary table and moves to an uppermost position above rotary table and above the surface of platform 16 (See FIG. 5). When kelly bushing 20 moves into an operative position adjacent and interconnecting with rotary table 14, (See FIG. 7) upper section 62 will move with kelly bushing 20 until the lower surface 61 of upper section 62 abutts the upper surface 69 of lower section 63. As can be seen in FIG. 7, the upper surface 69 of lower section 63 of guard 60 provides an annular surface corresponding to and connecting with in a supportive fashion the lowermost annular surface 61 of upper guard section 62.

Note that a plurality of guide plates 67 are provided, each guide plate being equipped with an inner inclined guiding surface 85 which assures proper registration of upper guard section 62 with lower guard section 63 and with surfaces 61, 69 abutting and connecting in a supportive fashion as is seen in FIG. 7.

When kelly bushing 20 moves in a downward fashion (See arrows, FIGS. 6 and 7) it can be seen that the upper guard section 62 will stop when lower surface 61 of upper guard 62 abutts and stops against the upper annular surface 69 of lower guard section 63. Continued downward movement of kelly bushing 20 which downward movement brings kelly bushing 20 into its desirable operative connection with rotary table 14 will cause kelly bushing 20 to part its frictional connection with mounting rings 74,72 and move into a free space 90 provided on the interior of lower guard section 63. The free space 90 is seen in FIG. 7 as an area within the walls 89 of lower guard section 63. It can be seen that when kelly bushing 20 is in its rotary operative connective position with rotary table 14, that it will not be in contact with any portion of kelly guard 60 including upper guard section 62 n and lower guard section 63. Likewise, kelly bushing 12 will not be in any connective or rotational connection with any portion of kelly guard 60 due to the opening 80 provided in upper shell section 62. Thus, the entire drilling assembly of kelly 12, kelly bushing 20 and drill string 55 will be free to rotate with rotary table 14 as is desirable with kelly bushing guard 60 assuming a fixed non-rotating guarding position on the deck portion 15 of platform 16 adjacent rotary table 14.

OPERATION

FIG. 4*a* illustrates safety guard 10 in its non-operative position where kelly bushing 20 has disengaged from rotary table 14 and is in a non-rotating position. FIG. 4*b* illustrates a downward operative position where kelly guard 20 is resting on the rig platform 15 in its coverable protective position above Kelly bushing 20 and rotary table 14. Turning now to FIG. 4*a* in the drawings, it can be seen that a pair of liner rings 32, 33 are provided which form a pliable cushioned attachment for Kelly bushing safety guard 10 to the kelly bushing 20 itself. In the preferred embodiment, a pair of rings 32, 33 are provided. There is first provided an upper pliable liner ring 32 which abutts and stops against the upper surface 21 of kelly bushing 20. A second lower liner ring 33 is provided which has an inner diameter D1 (See FIG. 4*a*). Liner ring 33 abutts the outer wall portion 23 of kelly bushing 20 and forms a frictional connective attachment thereto. Thus, upper ring 32 provides an attachment which connects kelly guard 10 to bushing 20 with respect to upward movement of bushing 20 while lower ring 33 provides a connection for kelly buahing guard 10 to bushing 20 with respect to lateral movement. The combined action of rings 32,33 provide a frictional abutting connection which grips and attaches kelly guard 10 to bushing 20 as is desirable when bushing 20 raises above the surface of rig platform 16 as is desirable. In FIG. 4*b*, there is illustrated the operation of the preferred embodiment when the kelly bushing guard 20 lowers into its operative connective rotation position interlocking with rotary table 14. Note that the enlarged lower section 63 provides an inner free space 90 within the walls 89 of lower section 63. Free space 90 assures that there will be no connection between kelly bushing 20 and lower guard section 63 when bushing 20 and rotary table 14 are interlocked in their rotational normal operative position.

Because many varing and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed as invention is:

1. A drilling rig kelly bushing and rotary table safety guard apparatus

Comprising:

a. A circular rotary drive table;

b. A kelly bushing associated with said rotary drive table and adapted for driving engagement therewith;

c. A drive kelly slideably engaged during drilling operation with said kelly bushing;

d. an outer shell adapted to coverably attach to said kelly bushing, said shell comprising, an upper shell section mountable on said kelly bushing, an opening being provided through said upper shell allowing the passage said kelly therethrough, said upper shell section having inner surface means for attaching said outer shell to said kelly bushing with said outer shell rising with the kelly bushing when it ascends from said rotary table during drilling operations;

a lower shell section integrally attached to said upper shell section and having an internal diameter greater than the internal diameter of said upper shell section, said lower shell providing an enlarged diameter greater than the diameter of the rotary table to be guarded and being capable of registering with and guarding said rotary table during drilling operations when said kelly busing and said rotary table are engaged; and e. a free space area adjacent said lower shell section and said cushioned means, said free space providing an area in which said kelly bushing with which said shell is operating, can freely rotate without contact with said shell while said shell assumes a non operative resting position about the rig rotary table.

2. The kelly bushing guard of claim 1 wherein said lower shell section is generally cylindrical and shaped to conform to the circular shape of said rotary table.

3. The kelly bushing guard of claim 2 wherein said lower shell section provides a free space under said upper shell section, said kelly bushing being freely rotatable within said free space, free the rotation of said kelly bushing within said free space not imparting rotation to said outer shell.

4. The kelly bushing guard of claim 3 wherein said kelly bushing enters said free space of said lower shell section when said kelly bushing assumes a close operative engaged position next to the rotary table portion of the well drilling rig.

5. The kelly bushing guard of claim 4 wherein said kelly bushing enters said free space of said lower shell section when said kelly bushing attaches to and abuts said rotary table portion of the well drilling rig.

6. The kelly bushing of claim 3 further comprising a flared skirt attached to the lower end portion of said upper shell section said flared skirt forming an integral connection between said upper shell section and said lower shell section.

7. The kelly bushing guard of claim 1 wherein said inner surface means is comprised of at least one pliable non-rigid member mounted on the inner wall portion of said outer shell.

8. The kelly bushing guard of claim 7 wherein a non-rigid frictional connection of said kelly bushing to said pliable non-rigid member is perfected when said kelly bushing rises from said rotary table and above said free space.

9. The kelly bushing guard of claim 1 wherein said inner surface means is comprised of a liner attached to the inner wall portion of said outer shell, said liner being of a pliable non-rigid material.

10. The kelly bushing guard of claim 1 wherein said inner surface means is comprised of at least one pliable non-rigid liner ring, said ring attached circumferentially to the inner wall portion of said outer shell.

11. The kelly bushing guard of claim 10 wherein two of said pliable non-rigid liner rings are provided, a first upper liner ring connectable to and abutting an upper sufrace of the kelly bushing and a second lower liner ring connectable to and abutting a side wall portion of the kelly bushing.

12. The kelly bushing guard of claim 11 wherein said kelly bushing conforms to and fits into said second lower ring to form a non-rigid, frictional connection of said kelly bushing to the upper shell section, said non-rigid frictional connection being perfected when said kelly bushing rises from said rotary table and above said free space, the continued upward movement of the kelly bushing contacting said kelly bushing with said first upper liner ring.

13. The kelly bushing guard of claim 1 wherein said lower shell section provides a free space, said kelly bushing being freely rotatable within said free space, said outer shell assuming a non-rotating position about said rotary table on the drilling rig floor during said free rotation of said kelly bushing within said free space, the continued upward movement of said kelly bushing above the rotary table and said free space perfecting a non-rigid frictional connection of said kelly bushing with said cushioned means.

* * * * *